US007104769B2

(12) United States Patent
Davis

(10) Patent No.: US 7,104,769 B2
(45) Date of Patent: Sep. 12, 2006

(54) PERISTALTIC PUMP AND METHOD WITH PARKING POSITION

(75) Inventor: Jeremy A. Davis, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 525 days.

(21) Appl. No.: 10/648,652

(22) Filed: Aug. 26, 2003

(65) Prior Publication Data

US 2005/0047925 A1 Mar. 3, 2005

(51) Int. Cl.
*F04B 43/12* (2006.01)

(52) U.S. Cl. ..... 417/477.9

(58) Field of Classification Search ..... 417/474, 417/476, 477.1, 477.8, 477.9
See application file for complete search history.

(56) References Cited

U.S. PATENT DOCUMENTS 320,888 A * 6/1885 Ruffel ..... 417/476
3,421,447 A 1/1969 Jackson et al.
3,447,478 A * 6/1969 Clemens ..... 417/477.8
3,724,974 A * 4/1973 Molimard ..... 417/477.9
3,787,148 A * 1/1974 Kopf ..... 417/477.8
3,930,761 A * 1/1976 Barraclough ..... 417/476
3,990,444 A * 11/1976 Vial ..... 417/477.9
4,536,776 A * 8/1985 Knirsch et al. ..... 347/55
4,558,996 A 12/1985 Becker
4,872,026 A 10/1989 Rasmussen et al.
4,909,713 A 3/1990 Finsterwald et al.
5,024,586 A 6/1991 Meiri
5,486,854 A 1/1996 Uchida
5,533,878 A 7/1996 Iwata
6,041,709 A 3/2000 Wells et al.
6,099,272 A 8/2000 Armstrong et al.

* cited by examiner

*Primary Examiner*—Michael Koczo, Jr.

(57) ABSTRACT

A peristaltic pump device and method includes at least one roller of a rotor rotatable with respect to an occlusion with a substantially constant radius. A depression is formed in the occlusion and extends beyond the substantially constant radius of the occlusion.

22 Claims, 2 Drawing Sheets

FIG. 2

PERISTALTIC PUMP AND METHOD WITH PARKING POSITION

BACKGROUND OF THE INVENTION

Related Art

A peristaltic pump moves liquid through tubing by alternate contractions and relaxations on the tubing. Flexible tubing is compressed by rollers that are rotated by a drive mechanism. As the rollers turn, they squeeze successive pockets of fluid through the tubing resulting in a pulsed, but continuous flow through the pump.

Traditionally, knowing the position of the pump has not been needed, and its position is typically not known. Thus, peristaltic pumps are traditionally designed to stop in random locations when not in use. Not knowing the position of the pump, or the stopping or starting positions of the pump, can result in difficulties in delivering a known amount of fluid, or can hinder precise metering. Such situations can exist when pumping ink for a printer. Such printers or pumps can be used infrequently, typically have low flows, and can require more precise metering of ink.

DETAILED DESCRIPTION

Figure 1:
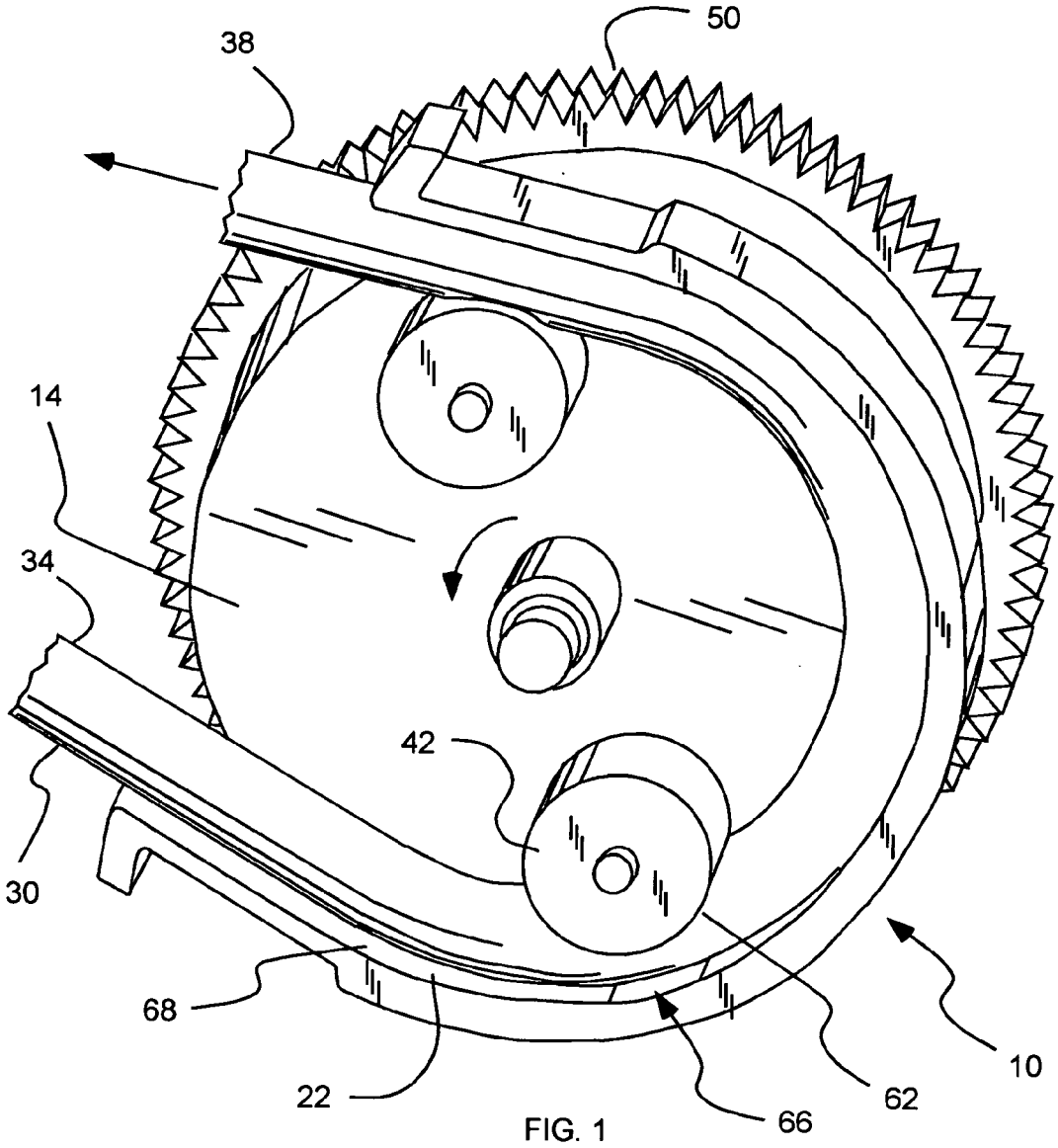
FIG. 1 is a partial perspective view of a peristaltic pump in accordance with an embodiment of the present invention.
Figure 4:
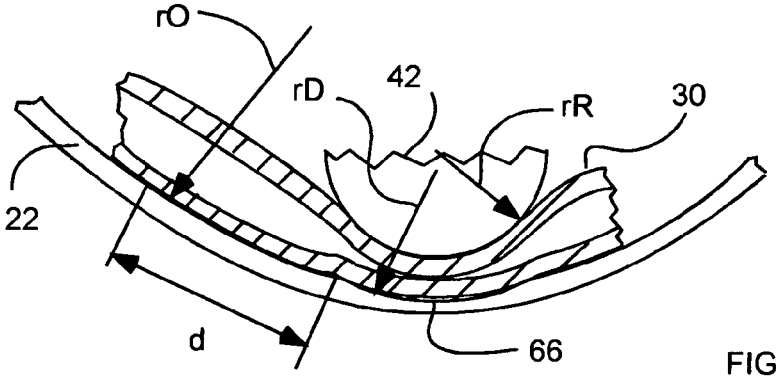
FIG. 4 is a partial side view of the peristaltic pump of FIG. 1.
Figure 2:
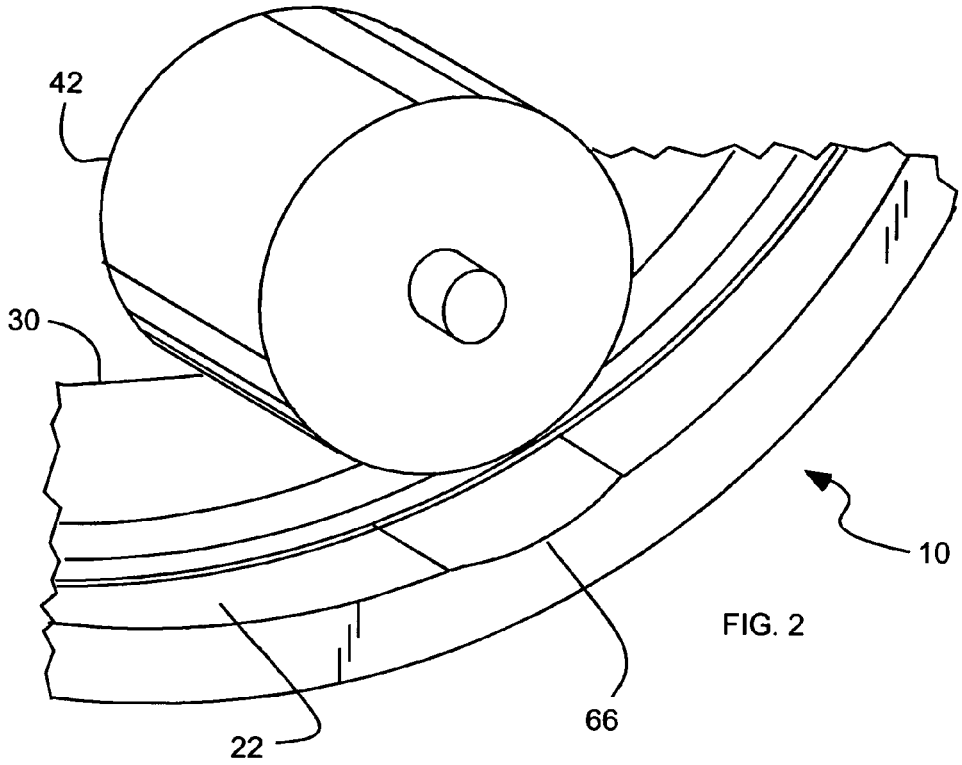
FIG. 2 is a partial detailed perspective view of the peristaltic pump of FIG. 1.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 1–4, a peristaltic pump, indicated generally at 10, in accordance with an embodiment of the present invention is shown for pumping a fluid. The peristaltic pump 10 can be configured to pump ink for a printer 12 (FIG. 3), such as an ink jet printer.

The peristaltic pump 10 or pump head includes a rotor 14 rotatably disposed in a housing (partially shown for clarity). A cavity or space can be formed in the housing for receiving the rotor 14. The housing includes an occlusion 22. The occlusion 22 is a physical structure or part within the pump that opposes the rollers, and against which the tube is occluded or squeezed (as described below). The occlusion 22 can be formed by an elongated, curved wall extending around at least a portion of the cavity or space, and can present a surface opposing the rollers (as described below). The occlusion 22 can be separate from the housing and held within the housing. Alternatively, the housing and the occlusion can be formed together as a single integral part. A flexible tube 30 is disposed in the housing against the occlusion 22. The tube 30 can extend in a curve around the curved wall, and can have an inlet 34 and an outlet 38.

One or more rollers 42 are rotatably disposed on, or coupled to, the rotor 14. In one aspect, the pump 10 or rotor 14 can include two rollers 42 on opposite sides of the rotor. It is understood that any number of rollers can be used, including for example, from one to eight rollers. As the rotor 14 rotates in the housing, the rollers 42 roll around the cavity or space. In addition, the rollers 42 bear against the tube 30 and occlude or squeeze the tube between the rollers 42 and the occlusion 22. It will be appreciated that as the rotor 14 rotates, the rollers 42 roll along the tube 30 occluding or squeezing pockets of fluid through the tube, thus pumping the fluid.

A motor, driver or the like 46 (FIG. 3) can be operatively coupled to the rotor 14 to drive or rotate the rotor 14. The motor 46 can be an electric motor, and can be coupled to the rotor 14 by a gear system, or one or more gears or sprockets (not shown). The rotor 14 can include a gear 50 formed thereon or coupled thereto to engage the gear system and/or receive rotational power from the motor 46. The motor 46 and/or gear system should provide sufficient torque to overcome the force of occluding or squeezing the tube 30, pressure of the fluid in the tube 30, friction of the rollers 42, friction of the rotor 14, friction of the fluid in the tube 30, etc.

The pump 10 can be coupled to an ink source or reservoir 54 (FIG. 3), to pump ink to a print head 58 (FIG. 3) or the like. Thus, an inlet 34 of the tube 30 can be operatively or fluidly coupled to the ink reservoir 54, while the outlet 38 of the tube 30 can be operatively or fluidly coupled to the print head 58. The ink reservoir 54 can contain ink, while the print head 58 can be operatively coupled to the ink reservoir and can print on a print medium, such as paper. The pump 10 can be operatively coupled between the ink reservoir 54 and the print head 58. As part of a printer, the pump 10 may be used relatively infrequently, or may remain inactive for relatively long periods of time, for example greater than one day or 24 hours. In addition, the pump 10 may be operated for a relatively short time, or to pump only a small amount of ink. Thus, in each pumping operation, the pump 10 may operate for only a relatively small number of revolutions, such as less than fifty. Furthermore, the pump 10 may be required to pump a known amount or volume of fluid or ink.

It is recognized that it would be advantageous to know the starting position of the pump, or similarly the stopping position of the pump. In addition, it is recognized that it would be advantageous to start the pump from a known position, and consequently to stop the pump at a known position. Stopping the pump in a known location insures that it is in a known state the next time the pump is started. Starting the pump in a known location allows for more precise metering of the fluid or ink.

Therefore, the pump 10 advantageously has a parking position 62 in which one of the rollers 42 is stopped or parked when the pump is stopped. The parking position 62 can present the roller 42 with a lower force applied by the tube to the roller with respect to the remaining locations in the revolution of the rollers along the tube. The parking position 62 can include a depression or indentation 66 formed in the occlusion 22. The depression 66 can form the lower force position so that the roller 42 tends to move into the parking position 62, and into the depression 66 when stopped near the depression. Thus, the roller 42 stops in a known position, and is in a known position when the pump is restarted. In one aspect, the parking position 62 and/or the depression 66 can be located nearer to a leading end 68 of the occlusion 22, or closer to the inlet 34. Thus, when the pump 10 is activated, the first revolution pumps a known amount of fluid.

In one aspect, the depression 66 can be sized and shaped to correspond to a size and shape of the roller 42 with the tube 30 therebetween. Thus, the depression 66 can be curved, and can have a radius rD. The roller 42 has a radius rR. The radius rD of the depression 66 can be greater than the radius rR of the roller 42 to accommodate the thickness of the tube 30 squeezed between the roller and the depression. The curvature of the depression 66 can be concentric with a curvature of the roller 42 so that the roller mates or matches with the depression while allowing for the squeezed tube therebetween. The occlusion 22 or the curved wall can have a substantially constant radius rO (except for the depression 66), with a single center point. Thus, the occlusion 22 can have a substantially constant or continuous curvature (except for the depression 66). The depression 66 can extend to a depth beyond the substantially constant radius rO of the occlusion 22. The radius rD of the depression 66 can be smaller than the radius rO of the occlusion 22. The size or length of the depression 66 along the occlusion 22 can be small compared to the active surface of the occlusion. For example, the length of the occlusion can be less than 10% of the length of the active surface of the occlusion 22. The depression 66 can form a single equilibrium position along the occlusion 22.

As stated above, the depression 66 presents the roller 42 with a lower force applied by the tube so that the roller 42 tends to move into the depression 66, and thus into the parking position 62 with a known position. As the roller 42 stops proximate to, or near to, the depression 66, the force applied by the tube 30 to the roller 42 will push the roller 42 until they reach an equilibrium position. In one aspect, it can be desirable to stop the roller 42 in close proximity to the depression 66 or parking position 62 to insure that the roller 42 moves to the parking position. For example, a center or axis of the roller 42 can be stopped at least at an edge of the depression 66, between the depression 66 and the occlusion 22. As another example, the roller 42 can be stopped within a distance d (FIG. 4) of the depression 66 less than diameter of the roller 42. The motor 46 can include a stepper motor to keep track of the position of the pump or roller 42 so that the pump or rotor is stopped with the roller close to the parking position 62. A stepper motor is an example of one means for stopping the rotor with the roller proximate the depression. Other means can be used, including for example, an encoder or control electronics. An encoder 70 (FIG. 3) could also be used to keep track of the position of the pump or roller 42. Similarly, control electronics or a controller 74 could be used to monitor the motor 46 or sensors to stop the roller 42 close to the parking position.

A method for pumping a fluid, or for using the pump 10 described above, can include introducing the fluid to an inlet 34 of a peristaltic pump 10 with a flexible tube 30 disposed between a housing with an occlusion 22 and a rotor 14 with a roller 42. The fluid can be introduced by operatively coupling the inlet 34 of the tube 30 to a fluid reservoir. The rotor 14 with the roller 42 is rotated, occluding the flexible tube 30 between the roller 42 and the occlusion 22 to drive the fluid through the flexible tube 30. The rotor 14 can be driven by a motor 46. The rotor 14, or rotation of the rotor, is stopped with the roller 42 at or near a depression 66 formed in the occlusion 22. The depression 66 can present the roller 42 with a lower force at a location of revolution corresponding to the depression.

As stated above, the pump 10 can form part of a printer 12, and can be used to pump ink. Thus, the method can further include waiting to rotate the roller 42 after stopping for a long period of time, such as at least one day. Rotation of the rotor 14 can then be restarted with the roller 42 at the depression 66, and thus at a known starting position.

Similarly, a method for controlling a peristaltic pump 10 for pumping a fluid includes providing such a peristaltic pump 10 with a flexible tube 30 disposed between a housing with an occlusion 22 and a rotor 14 with a roller 42. The rotor 14 is rotated with the roller 42 occluding the flexible tube 30 between the roller 42 and the occlusion 22 to drive the fluid through the flexible tube 30. The roller 42 is stopped at or near a parking position 62 with a lower force created by a depression 66 formed in the occlusion 22. Again, the pump 10 can form part of a printer 12, and can pump ink. Thus, the method can further include waiting to rotate the roller 42 after stopping for a long period of time, such as at least one day. Rotation of the rotor 14 can then be restarted with the roller 42 at the depression 66, and thus at a known starting position.

Figure 3:
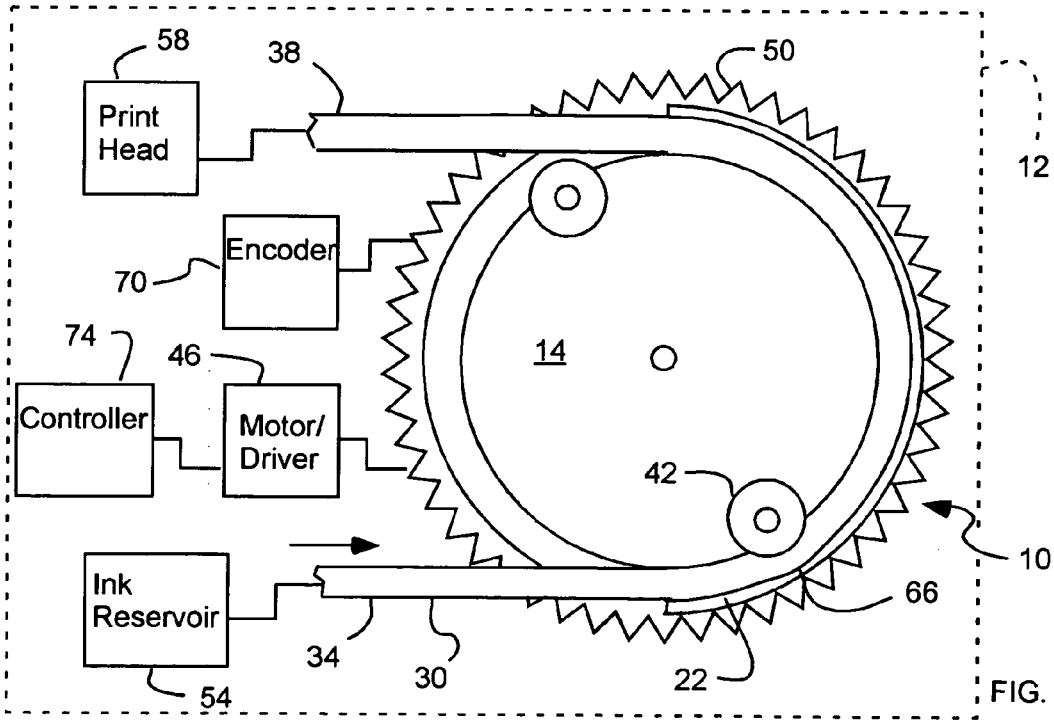
FIG. 3 is side schematic view of the peristaltic pump of FIG. 1 shown as part of a printer in accordance with an embodiment of the present invention.

Referring to FIG. 3, a printer 12 can include a print head 58 operatively coupled to an ink reservoir 54. The ink reservoir 54 can contain ink, while the print head 58 can print on a print medium, such as paper. The pump 10 can be operatively coupled between the ink reservoir 54 and the print head 58. The pump 10 can be driven by a motor 46.

As stated above, stopping the roller 42 or peristaltic pump 10 in a known location, or in the parking position 62, allows the pump to pump a known amount of liquid when it is activated. Knowing the stopping position of the roller 42 allows the volume or amount of fluid in the tube 30 to be determined. For example, the volume of fluid in the tube 30 can be calculated based on the geometry of the tube 30 and the position of the parking position 62, or can be determined empirically by measurement. In addition, stopping the roller 42 in the parking position 62 allows the motor to be operated a known amount, or the roller 42 to be rotated a known amount, to insure that the desired amount of fluid is pumped. In addition, it has been found that the fewer total number of revolutions that are required to move a desired volume, the more that first revolution affects total volume. For example, if a roller stops just at the beginning of the occlusion and is rotated 3.5 revolutions, a different amount is obtained than with the roller starting ½ way along the occlusion and then moving 3.5 revolutions. In addition, stopping the roller in the parking position 62 limits the areas of the tube 30 subject to continued pinching during non-use, thus limiting the areas of tube fatigue. Controlling the tube degradation results in more consistent performance over time. Furthermore, where the roller starts can affect how well the pump primes during the first revolution. A roller that is on the occlusion often does not move much fluid during the first pass. Making a full stroke with the roller appears to obtain enough negative pressure to get the pump started.

It should be noted that the pump can be operated in either direction, and thus the rotor 14 can be rotated in either direction. The roller stops in the parking position when the rotor rotates in either direction.

In addition, it will be appreciated that the tube geometry and material can be varied to facilitate operation of the parking position. Tubes with more resilient material or geometries will tend to actively push the roller into the parking position when the roller is stopped at or near the depression 66.

The pump can include a lead-in and/or a lead-out to the occlusion, as is known in the art. The lead-in or lead-out does not form part of the occlusion, or part of the active surface of the occlusion. The active surface being the surface against which the tube is completely occluded or squeezed by the roller.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A peristaltic pump device, comprising:

a) an occlusion with a substantially constant radius;

b) a flexible tube, disposed against the occlusion;

c) a rotor, rotatable with respect to the occlusion;

d) at least one roller, disposed on the rotor;

e) the at least one roller being bearable against the tube to occlude the tube between the roller and the occlusion as the rotor rotates; and f) a depression, formed in the occlusion, and extending beyond the substantially constant radius of the occlusion, and having a curvature that is substantially concentric with the at least one roller when the at least one roller is positioned at the depression.

2. A device in accordance with claim 1, wherein the curvature of the depression has a radius to match a radius of the at least one roller with the tube occluded therebetween.

3. A device in accordance with claim 1, wherein the tube is fluidly coupled to an ink reservoir of a printer.

4. A device in accordance with claim 1, further comprising:

means for stopping the rotor with the at least one roller within a distance of the depression less than a diameter of the at least one roller.

5. A device in accordance with claim 4, wherein the means for stopping the rotor includes an item selected from the group consisting of: an encoder, a stepper motor, and control electronics.

6. A device in accordance with claim 1, wherein the depression is located nearer an inlet of the tube than to an outlet of the tube.

7. A peristaltic pump device, comprising:

a) an occlusion having a substantially constant radius;

b) a rotor, rotatably disposed with respect to the occlusion;

c) a tube disposed against the occlusion;

d) at least one roller, disposed on the rotor, and bearable against the tube, to occlude the tube between the roller and the occlusion as the rotor rotates;

e) a parking position with a lower force applied by the tube to the roller relative to remaining locations of revolution of the at least one roller along the tube, and including a depression formed in the occlusion; and f) means for stopping the rotor with the at least one roller within a distance of the depression less than a diameter of the at least one roller.

8. A device in accordance with claim 7, wherein the depression has a curvature corresponding to a curvature of the at least one roller with the tube therebetween.

9. A device in accordance with claim 7, wherein the depression is concentric with the roller when the roller is positioned at the depression.

10. A device in accordance with claim 7, wherein the depression is located nearer to an inlet of the tube than to an outlet of the tube.

11. A device in accordance with claim 7, wherein the means for stopping the rotor includes an item selected from the group consisting of: an encoder, a stepper motor, and control electronics.

12. A device in accordance with claim 7, wherein the tube is fluidly coupled to an ink reservoir of a printer.

13. A method for pumping a fluid, comprising:

a) rotating a rotor with at least one roller to occlude a tube between the at least one roller and an occlusion with a substantially constant radius to drive fluid through the flexible tube; and b) stopping rotation of the rotor with the at least one roller within a distance of a depression formed in the occlusion less than a diameter of the at least one roller, the depression having a curvature that is substantially concentric with the at least one roller when the at least one roller is positioned at the depression.

14. A method in accordance with claim 13, wherein the step of stopping the at least one roller at or near the depression includes presenting the roller with a lower force applied by the tube to the roller at a location of revolution corresponding to the depression.

15. A method in accordance with claim 13, further comprising the steps of:

a) waiting to rotate the roller after stopping for at least one day; and b) restarting rotation of the rotor with the roller at the depression.

16. A method in accordance with claim 13, wherein the step of introducing fluid further includes introducing ink.

17. A method for controlling a peristaltic pump for pumping a fluid, comprising the steps of:

a) rotating a rotor with at least one roller to occlude a tube between the roller and an occlusion with a substantially constant radius to drive the fluid through the flexible tube; and b) stopping the at least one roller at a parking position with a lower force applied by the tube to the roller and within a distance of a depression formed in the occlusion less than a diameter of the at least one roller, with the depression having a curvature corresponding to a curvature of the at least one roller with the tube therebetween.

18. A method in accordance with claim 17, further comprising the steps of:

a) waiting to rotate the roller after stopping for at least one day; and b) restarting rotation of the rotor with the roller at the depression.

19. A method in accordance with claim 17, further comprising the step of introducing ink to an inlet of the pump.

20. A printer, comprising:

a) an ink reservoir configured to contain ink;

b) a print head, operatively coupled to the ink reservoir, configured to print ink onto a print medium; and c) a pump, operatively coupled between the ink reservoir and the print head, having a flexible tube disposed between an occlusion and at least one roller of a rotor rotatable with respect to the occlusion, the occlusion having a substantially constant radius;

d) the pump having a parking position with a lower force applied by the tube to the roller relative to remaining locations of revolution of the at least one roller along the tube, and including a depression formed in the occlusion; and f) the depression having a curvature substantially concentric with the at least one roller when the at least one roller is positioned at the depression.

21. A printer in accordance with claim 20, further comprising:

means for stopping the rotor with the at least one roller within a distance of the depression less than a diameter of the at least one roller.

22. A printer in accordance with claim 21, wherein the means for stopping the rotor includes an item selected from the group consisting of: an encoder, a stepper motor, and control electronics.

* * * * *

UNITED STATES PATENT AND TRADEMARK OFFICE

CERTIFICATE OF CORRECTION

PATENT NO. : 7,104,769 B2
APPLICATION NO. : 10/648652
DATED : September 12, 2006
INVENTOR(S) : Jeremy A. Davis It is certified that error appears in the above-identified patent and that said Letters Patent is hereby corrected as shown below:

In column 5, line 49, in Claim 6, after “nearer” insert -- to --.

Signed and Sealed this

Thirtieth Day of December, 2008

JON W. DUDAS
*Director of the United States Patent and Trademark Office*